US005992510A

United States Patent [19]

Källrot

[11] Patent Number: 5,992,510

[45] Date of Patent: Nov. 30, 1999

[54] PLATE HEAT EXCHANGER

[75] Inventor: Karl Magnus Källrot, Wolverhampton, United Kingdom

[73] Assignee: Alfa Laval AB, Tumba, Sweden

[21] Appl. No.: 09/091,622

[22] PCT Filed: Dec. 20, 1996

[86] PCT No.: PCT/SE96/01728

§ 371 Date: Jun. 18, 1998

§ 102(e) Date: Jun. 18, 1998

[87] PCT Pub. No.: WO97/23759

PCT Pub. Date: Jul. 3, 1997

[30] Foreign Application Priority Data

Dec. 21, 1995 [SE] Sweden ..... 9504586

[51] Int. Cl.[6] ..... F28F 3/08

[52] U.S. Cl. ..... 165/78; 165/167

[58] Field of Search ..... 165/76, 78, 166, 165/167

[56] References Cited

U.S. PATENT DOCUMENTS 2,648,527 8/1953 Carnahan .
4,249,597 2/1981 Carey .
4,872,578 10/1989 Fuerschbach et al. .
5,307,869 5/1994 Blomgren .

FOREIGN PATENT DOCUMENTS 0 481 871 4/1992 European Pat. Off. .
1204004 9/1970 United Kingdom .
1275711 5/1972 United Kingdom .

*Primary Examiner*—Leonard Leo
*Attorney, Agent, or Firm*—Fish & Richardson P.C.

[57] ABSTRACT

A plate heat exchanger comprises heat transfer plates (5) provided with port holes (2*a*). The plates are compression-molded relative to a reference plane and permanently joined to each other to a plate package to form heat transfer passages between adjacent heat transfer plates (5) and at least one port hole channel through the package. The plates (5), through the compression-molding, have contact portions (9) which through the permanent joining form areas of the plate package that lack any connection to the heat transfer passages. An aperture (3*a*) is made in each of the portions (9). Such apertures (3*a*) form at least one attachment member channel extending through the plate package and being adapted to receive an attachment member for attachment of the plate heat exchanger to a support member or a mounting plate.

8 Claims, 5 Drawing Sheets

PLATE HEAT EXCHANGER

TECHNICAL FIELD OF THE INVENTION AND PRIOR ART

The present invention refers to a plate heat exchanger comprising heat transfer plates provides with port holes, said plates being compression-moulded relative to a reference plane, and permanently joined to each other, for instance by brazing, to a plate package in such a manner that heat transfer passages are formed between adjacent heat transfer plates and at least one port hole channel is formed through said package by said port holes, wherein the heat transfer plates through said compression-moulding have been provided with contact portions which through said permanent joining of the plate package form areas of the plate package that lack any connection to said heat transfer passages.

Such brazed plate heat exchangers are used in a wide variety of applications, e.g. as oil coolers for vehicle engines. Problems occur when the plate heat exchanger is to be attached for instance to an engine or connection pipes with regard to the sealing between the plate heat exchanger and said engine or connection pipes around the port hole channels of the heat exchanger. Frequently, it is necessary to use further space requiring components, for instance brackets having a mounting loop to be tightened around the plate heat exchanger. Furthermore, it is possible to attach the plate heat exchanger by means of screws screwed into threaded holes in an end plate of the plate heat exchanger. Thereby, the end plate has to be more rigid and thicker than otherwise would have been the case. Besides the fact that these previously known methods of attaching a plate hear exchanger involve the use of many further components, these methods also involve a time-consuming and labour-intensive mounting.

WO-A-9 417 354 discloses a plate heat exchanger having a stack of heat transfer plates clamped together by means of tie bars extending laterally of the heat transfer plates between two end plates. The area carrying the heat transfer medium between the heat transfer plates is sealed off by means of gaskets. Thus, by means of these gaskets heat transfer medium is prevented from penetrating an area near the periphery of the plates and in this area cut-outs have been made for tie bars and for rails by which the heat transfer plates may be suspended.

GB-A-2 208 005 discloses a similar plate heat exchanger having heat transfer plates clamped between two end plates and a small detection aperture in the periphery of the heat transfer plates outside the heat transfer area in order to detect a leakage in this area.

GB-A-1 275 711 discloses a similar plate heal exchanger having heat transfer plates clamped between two end plates and a small detection aperture in the periphery of the heat transfer plates outside the heat transfer area. In this aperture, being asymmetrically positioned, a thin bar is introduced to assure a proper orientation of the heat transfer plates during the mounting.

U.S. Pat. No. 4,249,597 discloses a plate heat exchanger of another type having heat transfer plates brazed together in pairs. Thereafter, such pairs are stacked together and not brazed but clamped together by means of two bolts extending through the heat exchange plates, in order to provide a plate heat exchanger having double walls between the heat transfer passages.

GB-A-1 204 004 discloses a brazed plate heat exchanger comprising a package of heat transfer plates provided between enclosing casing parts. Furthermore, the heat exchanger comprises two locating pins provided in holes extending through the heat exchanger and functioning to position the different parts properly during the brazing process. During the brazing process the parts are drawn together by means of clips, whereafter all parts, i.e. the heat transfer plates, the casing parts and the locating pins, are heated and brazed together. In order to locate inlet and outlet pipes at the plate heat exchanger, a clip may be brazed to at least one of the casing parts.

SUMMARY OF THE INVENTION

The object of the present invention is to provide a plate heat exchanger which in a simple and cost-effective manner may be attached to a support member or to a mounting plate. Furthermore, the invention aims at providing a plate heat exchanger having attachment means being as small and compact as possible.

This object is obtained by the plate heat exchanger initially defined and characterized in that an aperture is made in each of said contact portions and that such apertures form at least one attachment member channel extending through the plate package and being adapted to receive an attachment member for attachment of the plate heat exchanger to a support member or a mounting plate. By means of such an attachment member channel formed by the apertures it is possible to attach the plate heat exchanger to a support member in a simple and compact manner. It is also possible to connect the port hole channels of the plate heat exchanger to different types of fluid channels in a simple and compact manner. Therefore, the plate heat exchanger need not be provided with a number of further, space requiring and expensive components for its connection and/or attachment.

According to one embodiment of the present invention, each of said contact portions is situated on a level differing from that of a surface portion at least partly surrounding the contact portion. Thereby, a contact portion of one heat transfer plate may be permanently joined to a contact portion of an adjacent heat transfer plate in such a manner that said attachment member channel is delimited from the heat transfer passages. This may be realized by the feature that a heat transfer plate comprises a first surface portion located at a first level and a second surface portion located at a second level, said first and second levels being situated on either side of said reference plane, and that in the area of said first surface portion at said first level, a contact portion is situated at said second level, and in the area of said second surface portion situated at said second level, a contact portion is situated at said first level. Furthermore, said contact portions of a first heat transfer plate are permanently joined to adjacent second and third heat transfer plates on respective sides of said first heat transfer plate.

According to another embodiment of the present invention and in order not to reduce the heat transfer area of the plate heat exchanger, at least one of said contact portions has a said aperture situated near the periphery of the relevant heat transfer plate.

According to a further embodiment of the present invention, at least one attachment member is provided to extend through said attachment member channel and arranged for said attachment of the plate heat exchanger to said support member or mounting plate. Such an attachment member may comprise a bolt-like member extending through the attachment member channel for said attachment.

According to a further embodiment of the present invention, each heat transfer plate is elongated and has four port holes being provided in pairs with two port holes at each end of the heat transfer plate and there is provided one aperture between the port holes of each pair.

BRIEF DESCRIPTION OF THE DRAWINGS

The present invention will now be explained more closely by means of different embodiments disclosed in the drawings attached hereto.

DETAILED DESCRIPTION OF DIFFERENT EMBODIMENTS

Figure 1:
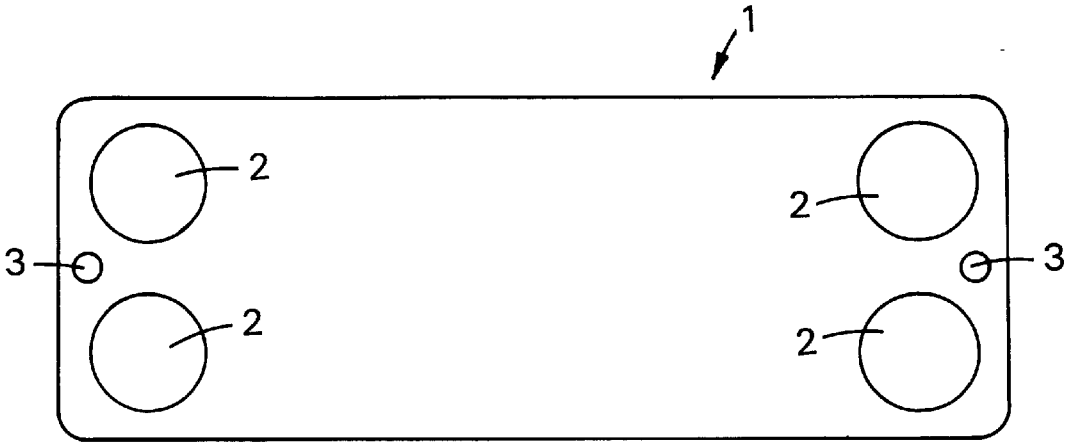
FIG. 1 discloses a schematical view from above of a plate heat exchanger.
Figure 2A:
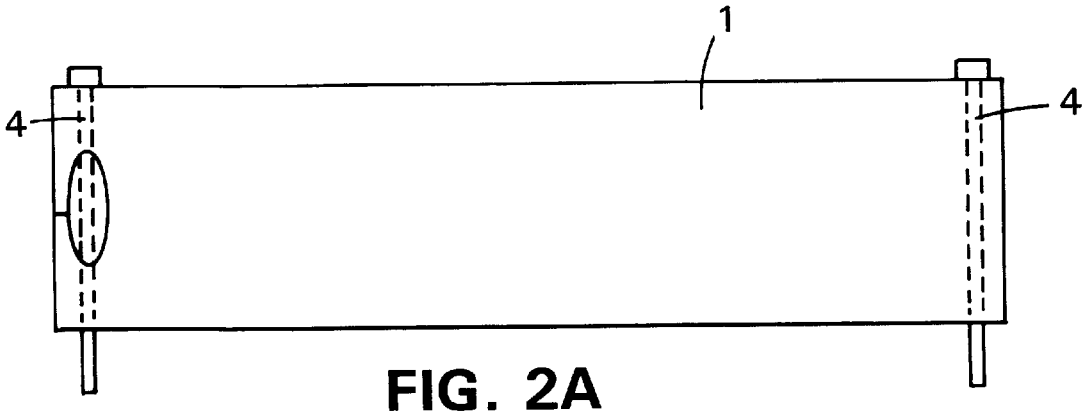
FIG. 2A discloses a side-view of the plate heat exchanger in FIG. 1.
Figure 2B:
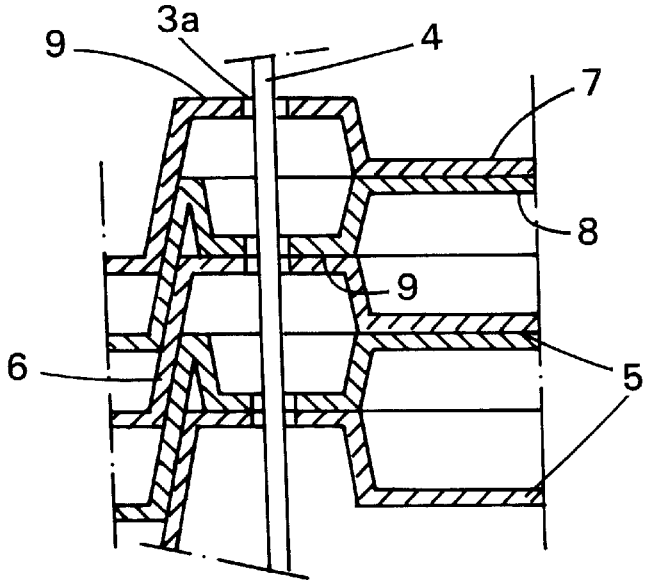
FIG. 2B discloses a sectional view of a part of the plate heat exchanger in FIG. 2A.
Figure 3:
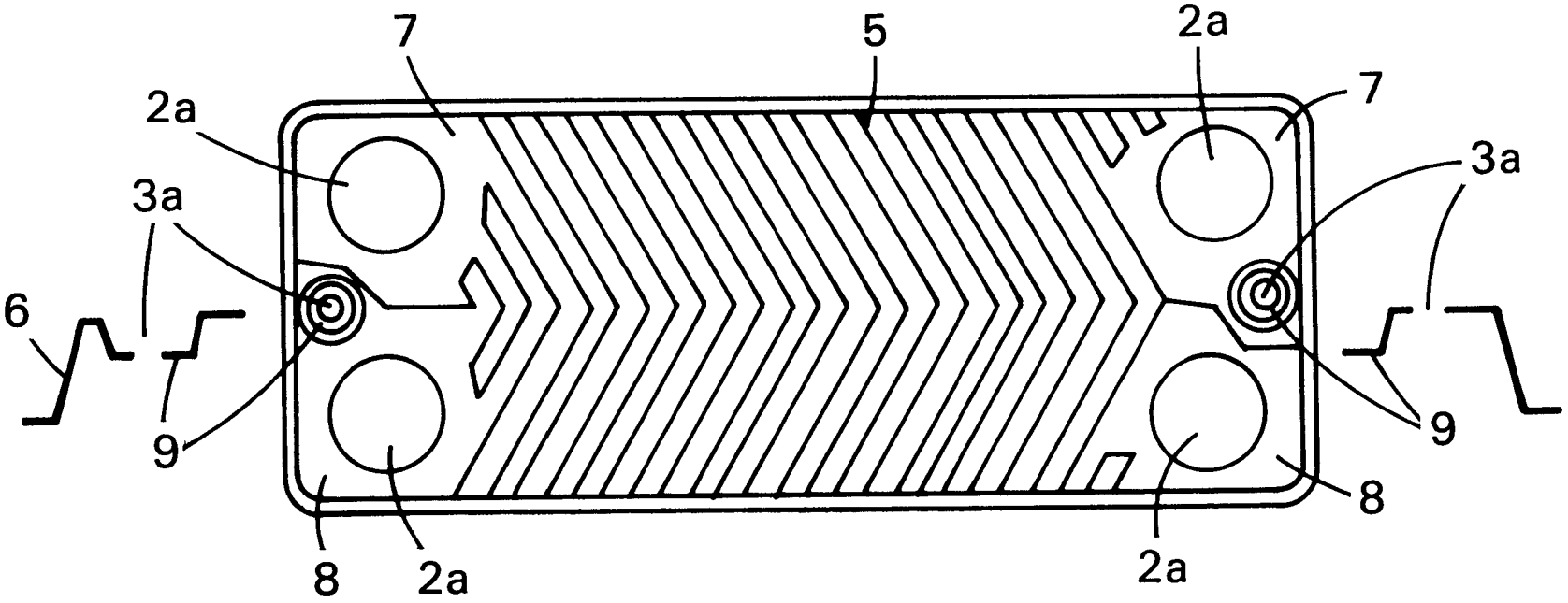
FIG. 3 discloses a view from above of a heat transfer plate.

FIGS. 1, 2A and 2B disclose an elongated plate heat exchanger 1 having four port hole channels 2, forming the inlet and the outlet respectively, for the heat transfer passages for two media to be conducted through the plate heat exchanger 1. The four port hole channels 2 of the plate heat exchanger 1 are provided in pairs with two port hole channels 2 at each end. Between each pair of port hole channels 2 an attachment member channel 3 extends through the plate heat exchanger 1. The attachment member channel 3 is located in an area of the plate heat exchanger 1 which none of the heat transfer media may reach. Through the attachment member channel 3 an attachment member 4 such as a bolt-like member extends for different attachment purposes to be described more closely below. The plate heat exchanger 1 comprises a great number of heat transfer plates 5 stacked together to form a plate package. The heat transfer plates 5 are compression-moulded relative to a reference plane, and have a pattern more closely disclosed in FIGS. 3 and 4, in two different but similar kinds. Each heat transfer plate 5 has a relatively elongated shape with two port holes 2*a* and one aperture in the form of a hole 3*a* at each short side. Furthermore, each heat transfer plate 5 comprises a downwardly bent edge 6, a first surface portion 8 at a first level with respect to said reference plane and a second surface portion 7 at a second level with respect to said reference plane. The first and second surface portions 8, 7 are situated on either side of said reference plane. The heat transfer passages are formed by means of the arrow pattern disclosed in FIGS. 3 and 4 in such a manner that the heat transfer plates 5 are stacked with the arrow pattern in each second heat transfer plate 5 directed to the right and in the remaining plates directed to the left. Around the hole 3*a* each heat transfer plate 5 has a contact portion 9, being located on a level differing from that of the surrounding surface portion 7, 8. Consequently, when the hole 3*a* is situated at the second surface portion 7 at the second level, the surface of the contact portion 9 is situated at the same level as the first surface portion 8, and when the hole 3*a* is situated at the first surface portion 8 at the first level, the surface of the contact portion 9 is situated at the same level as the second surface portion 7. When the plates 5 are stacked according to the method described above and brazed together, the contact portions 9 will, as is disclosed in the magnified section view of FIG. 2B, abut each other and provide an area which is not accessible from any of the heat transfer passages. Because of this, it is thus possible to provide a hole 3*a* in the centre of the contact portion 9 without any risk for leakage. Thus, the holes 3*a* of the heat transfer plates 5 stacked together form the attachment member channel 3.

FIGS. 5 to 8 disclose how the plate heat exchanger 1 is connected to connection pipes 10 via the port hole channels 2 for the in-flow and out-flow, respectively, of heat transfer medium to and from the heat transfer passages of the plate heat exchanger 1. Each connection pipe 10 comprises a flange 11 projecting radially and, in the example disclosed, extending around the whole periphery of the connection pipe 10. Below the flange 11 the connection pipe 10 has a continuing portion 12 having such a diameter that it precisely may be introduced into one of the port hole channels 2. Around the continuing portion 12 a sealing ring 13 is provided, which in the example disclosed is in the form of an O-ring. Consequently, when the continuing portion 12 of the connection pipe 10 is introduced into a port hole channel 2 the sealing ring 13 will abut an outermost plate 15. The two outermost plates are called the end plates 14 and 15 and have a somewhat greater thickness of material than the heat transfer plates 5. A mounting plate 16 is positioned on the connection pipes 10. The mounting plate 16 comprises a protecting portion 17 projecting from one surface of the mounting plate 16 about as much as the height of the flange 11 and abutting the end plate 15. Besides openings for the connection pipes 10, a hole 18 is made in the mounting plate 16, which extends through the mounting plate 16 in the area of the projecting portion 17. In order to sealingly connect the connection pipes 10 to the plate heat exchanger 1 the bolt-like member, which in the example disclosed is comprised of a threaded bolt 19, is introduced through the hole 18 and the attachment member channel 3 and by means of a nut 20 the mounting plate 16 and thus the flanges 11 with the sealing rings 13 are tightened against the end plate 15 of the plate heat exchanger 1. Between the nut 20 and the end plate 14 a strengthening washer 21 may be provided. Of course, the bolt 19 may be introduced from the other side, in which case the nut 20 will be located on the same side as the mounting plate 16. The disclosed bolt 19 having a screw and a nut may also be comprised of other bolt-like members, for example a bar having fixed heads, a bar extending through the plate heat exchanger 1 and welded to the end plates 14, 15, etc. The mounting plate 16 may be shaped in many different ways, for example as disclosed to the left in FIG. 5 where the openings of the mounting plate 16 are in the form of recesses, which is advantageous in the cases when the connection pipes 10 are fixed and thus may not be introduced into holes in the mounting plate 16 as disclosed to the right in FIG. 5. Furthermore, the mounting plate 16 may be configured as individual plates for each connection pipe 10 or as one single plate for all connection pipes 10.

Figure 4:
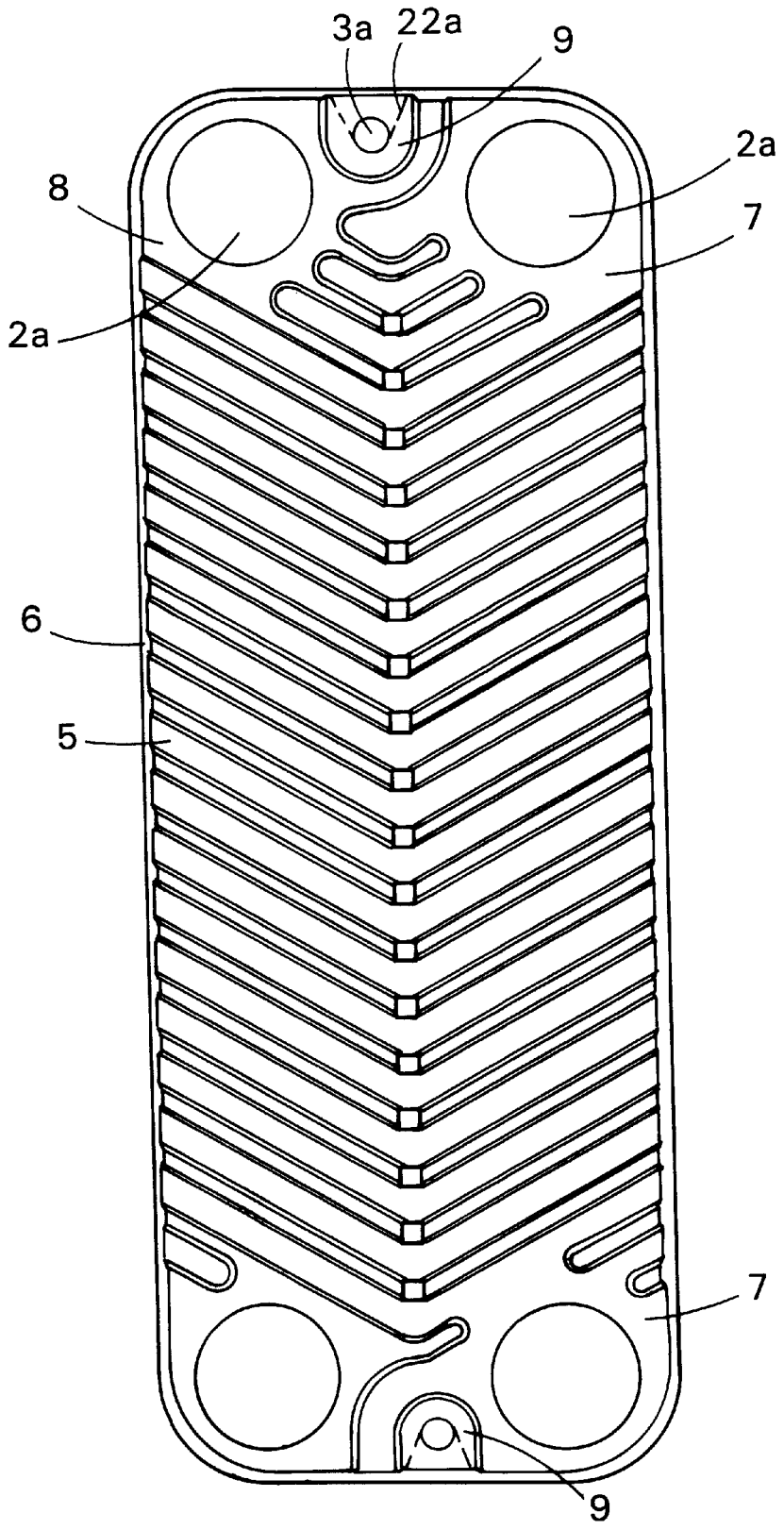
FIG. 4 discloses a view from above of a heat transfer plate similar to the one in FIG. 3.
Figure 5:
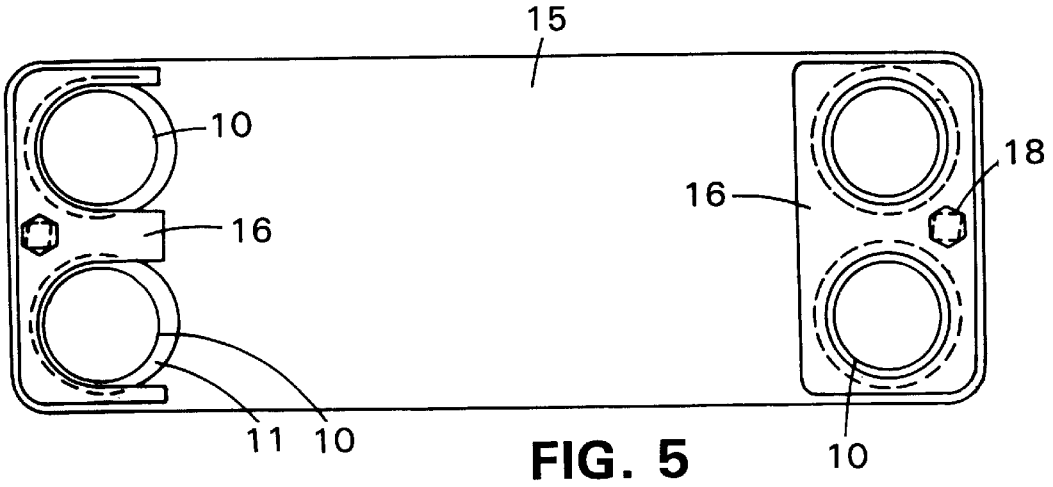
FIG. 5 discloses a view from above of a plate heat exchanger having a mounting plate for connection pipes.
Figure 6:
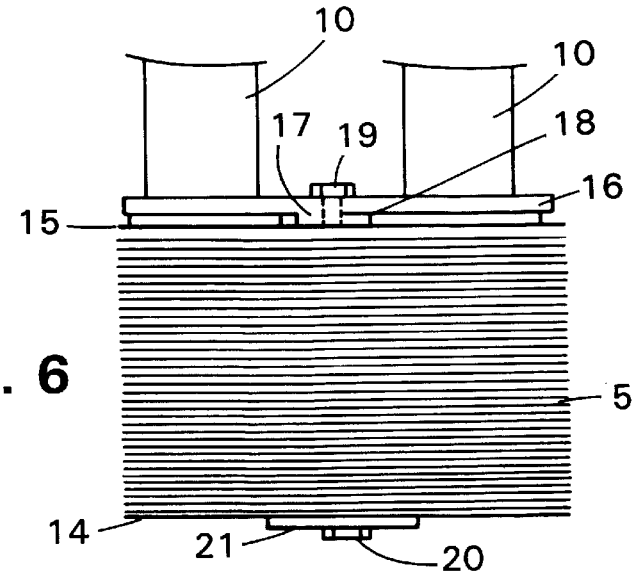
FIG. 6 discloses a view from the short side of the plate heat exchanger in FIG. 5.
Figure 7:
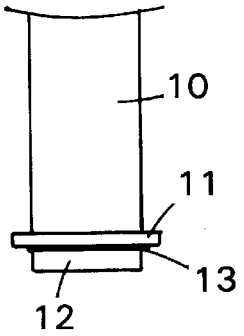
FIG. 7 discloses a connection pipe.
Figure 8:
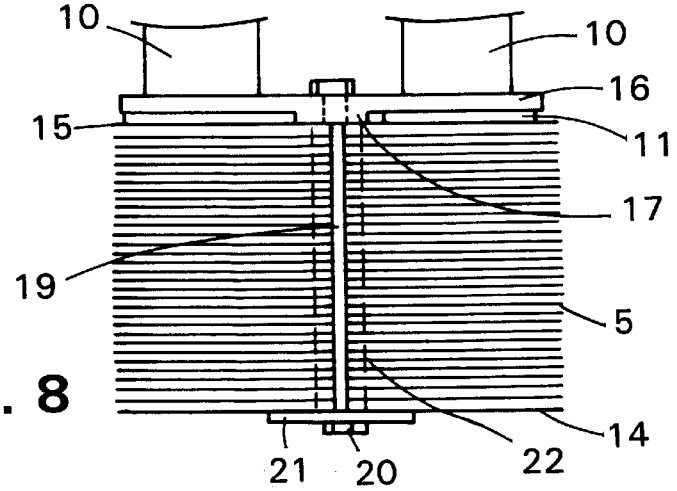
FIG. 8 discloses a side-view similar to the one in FIG. 6 of an alternative embodiment.

FIG. 8 discloses an attachment member channel in the form of a groove formed by recesses or cut-outs 22*a* in the end portions of each heat transfer plate 5. Such a cut-out 22*a*, which is disclosed by dotted lines in FIG. 4, is surrounded in the same way as the hole 3*a* of a corresponding contact portion 9. Thus, also the cut-outs 22*a* of the heat transfer plates 5 stacked together form an attachment member channel 22 which is delimited from the heat transfer passages of the plate heat exchanger 1 and through which the bolt 19 extends. It should also be noted that the hole 3*a* or the cut-out 22*a* not necessarily have to be provided between a pair of port holes 2*a*. According to the present invention, it is for example possible to provide a plate heat exchanger 1 with only one attachment member channel 3 situated in the centre thereof.

Figure 9:
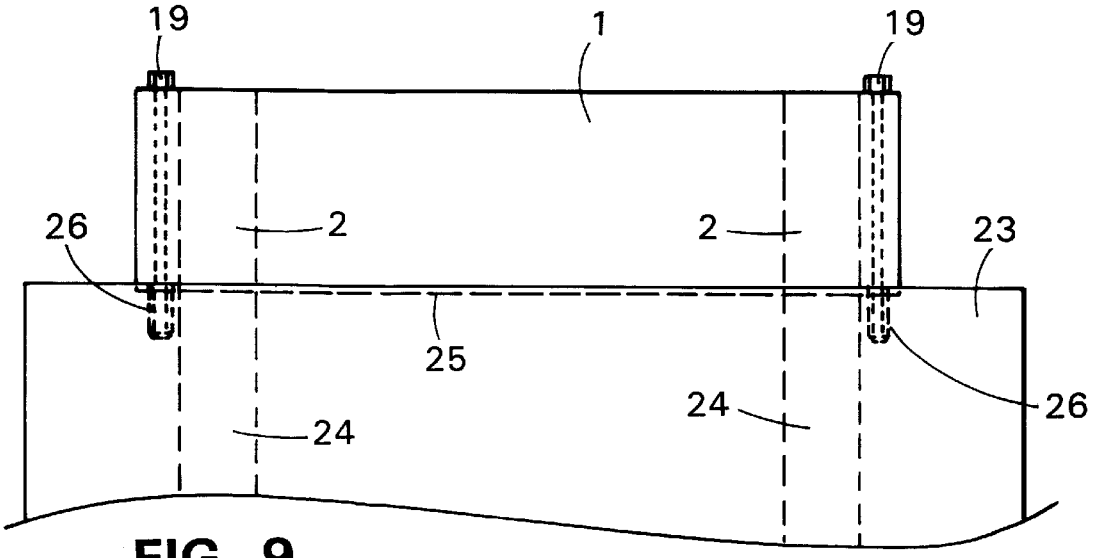
FIG. 9 discloses a side-view of a plate heat exchanger being attached to a base member.

FIG. 9 discloses another way of arranging the plate heat exchanger 1 according to the present invention. In this example the plate heat exchanger 1 is directly attached to a schematically disclosed support member 23, which for example may be a part of a vehicle engine. Through the support member connection channels 24 extend in alignment with the port hole channels 2 of the plate heat exchanger 1. in order to obtain a proper sealing of the connection between the porz hole channels 2 and the connection channels 24 a gasket 25 is provided between the plate heat exchanger 1 and the support member 23. In this case the plate heat exchanger 1 is attached in a particularly simple manner by bolts 19 extending through the attachment member channel of the plate heat exchanger 1 and being screwed to threaded holes 26 in the support member 23. It should be noted that the gasket 25 also may be provided as individual gaskets, one for each port hole channel 2.

Figure 10:
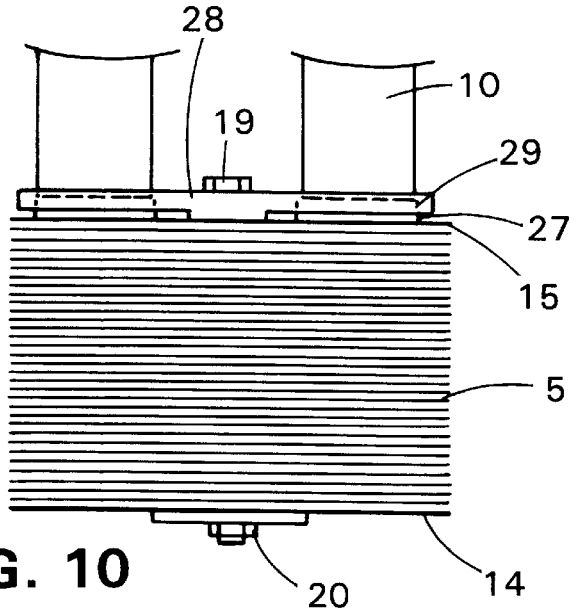
FIG. 10 discloses a side-view similar to the one in FIG. 6 of an alternative embodiment.
Figure 11:
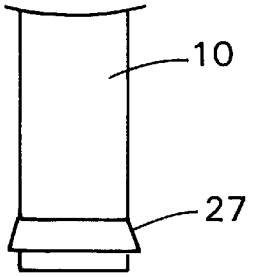
FIG. 11 discloses an alternative connection pipe.

FIGS. 10 and 11 disclose an alternative way of connecting a connection pipe 10 to the port hole channel 2 of the plate heat exchanger 1. Around the connection pipe 10 a conically tapered sealing ring 27 is provided. A mounting plate 28 having openings 29 being conically tapered in a corresponding way, is tightened against the plate heat exchanger 1 by means of the bolt 19 such that the sealing ring 27 may be pressed against the end plate 15 and the connection pipe 10 and thus connect the pipe 10 to the plate heat exchanger 1. Simultaneously, an effective sealing of the connection between the port hole 2 and the connection pipe 10 is obtained.

The plate heat exchanger according to the present invention may be utilized in many different applications where it is essential to keep the cost of mounting and the components on a low level. Besides the application for combustion engines the plate heat exchanger according to the present invention may also for example be used in oil coolers for gear boxes or compressors, for hot water heaters or for central heating devices etc.

What is claimed is:

1. A plate heat exchanger (1) comprising heat transfer plates (5) provided with port holes (2*a*), said plates (5) being compression-molded relative to a reference plane, and permanently joined to each other to form a plate package in such a manner that heat transfer passages are formed between adjacent heat transfer plates (5) and at least one port hole channel (2) is formed through said package by said port holes (2*a*), wherein the heat transfer plates (5) through said compression-molding have contact portions (9) which, through said permanent joining of the plates (5) in the plate package, form areas of the plate package that lack any connection to said heat transfer passages, wherein an aperture (3*a*, 22*a*) is made in each of said contact portions (9) and said apertures (3*a*, 22*a*) form at least one attachment member channel (3, 22) extending through the plate package and being adapted to receive an attachment member (4, 19) for attachment of the plate heat exchanger (1) to a support member (23) or to a mounting plate (16, 28), each of said contact portions (9) being situated on a level differing from that of a surface portion (7, 8) at least partly surrounding the contact portion (9), and at least one of said contact portions (9) of one heat transfer plate (5) being permanently joined to at least one of the contact portions (9) of an adjacent heat transfer plate (5) in such a manner that said attachment member channel (3, 22) is delimited from the heat transfer passages.

2. The plate heat exchanger according to claim 1, wherein at least one of said contact portions (9) has said aperture (3*a*, 22*a*) situated near the periphery of the relevant heat transfer plate (5).

3. The plate heat exchanger according to claim 1, having at least one attachment member (4, 19) extending through said attachment member channel (3, 22) and arranged for attachment of the plate heat exchanger (1) to said support member (23) or mounting plate (16, 28).

4. The plate heat exchanger according to claim 3, wherein the attachment member comprises a bolt-like member (19) extending through the attachment member channel (3, 22) for said attachment.

5. The plate heat exchanger according to claim 1, wherein each of said heat transfer plates (5) is elongated and has four port holes (2*a*) being provided in pairs with two of the port holes (2*a*) at each end of the heat transfer plate (5) and having one said aperture (3*a*, 22*a*) between the port holes (2*a*) of each pair.

6. A plate heat exchanger (1) comprising heat transfer plates (5) provided with port holes (2*a*), said plates (5) being compression-molded relative to a reference plane, and permanently joined to each other to form a plate package in such a manner that heat transfer passages are formed between adjacent heat transfer plates (5) and at least one port hole channel (2) is formed through said package by said port holes (2*a*), wherein the heat transfer plates (5) through said compression-molding have contact portions (9) which, through said permanent joining of the plates (5) in the plate package, form areas of the plate package that lack any connection to said heat transfer passages, wherein an aperture (3*a*, 22*a*) is made in each of said contact portions (9) and said apertures (3*a*, 22*a*) form at least one attachment member channel (3, 22) extending through the plate package and being adapted to receive an attachment member (4, 19) for attachment of the plate heat exchanger (1) to a support member (23) or to a mounting plate (16, 28), each of said contact portions (9) being situated on a level differing from that of a surface portion (7, 8) at least partly surrounding the contact portion (9), and at least one of the heat transfer plates (5) having a first surface portion (8) located at a first level and a second surface portion (7) located at a second level, said first and second levels being situated on either side of said reference plane, and in the area of said first surface portion (8), situated at said first level, one of the contact portions (9) is situated at said second level, and in the area of said second surface portion (7), situated at said second level, one of the contact portions (9) is situated at said first level.

7. The plate heat exchanger according to claim 6, wherein said contact portions (9) of one of the heat transfer plates (5), are permanently joined to contact portions (9) of adjacent heat transfer plates (5) oil respective sides of said one of the heat transfer plates.

8. The plate heat exchanger according to claim 6, wherein the contact portions (9) of two of said heat transfer plates (5), forming a pair of adjacent heat transfer plates (5), are joined to each other, and the first surface portion (8) of one such pair is joined to the second surface portion (7) of a second such pair positioned adjacent said one pair.

* * * * *

UNITED STATES PATENT AND TRADEMARK OFFICE
CERTIFICATE OF CORRECTION

PATENT NO. : 5,992,510

DATED : NOVEMBER 30, 1999

INVENTOR(S) : KARL MAGNUS KALLROT

It is certified that error appears in the above-identified patent and that said Letters Patent is hereby corrected as shown below:

Title page, under References Cited, insert the following:

--U.S. Patent Documents

| | | |
|---|---|---|
| 2,610,834 | 9/1952 | Dalzell |
| 2,639,126 | 5/1953 | Newhall |
| 4,903,758 | 2/1990 | Cowan |
| 5,740,859 | 4/1998 | Finch |

Foreign Patent Documents

| | | |
|---|---|---|
| 1,298,240 | 11/1972 | U.K. |

UNITED STATES PATENT AND TRADEMARK OFFICE

CERTIFICATE OF CORRECTION

PATENT NO. : 5,992,510

DATED : NOVEMBER 30, 1999

INVENTOR(S) : KARL MAGNUS KALLROT

It is certified that error appears in the above-indentified patent and that said Letters Patent is hereby corrected as shown below:

Col. 1, line 6, change "provides" to --provided--.

Col. 1, line 31, change "hear" to --heat--.

Col. 4, line 37, change "protecting" to --projecting--.

Col. 5, line 22, change "porz" to --port--.

Col. 7, line 1, change "oil" to --on--.

Signed and Sealed this

Tenth Day of April, 2001

*Attest:*

Nicholas P. Godici

NICHOLAS P. GODICI

*Attesting Officer*

*Acting Director of the United States Patent and Trademark Office*